US011779168B2

(12) United States Patent
Sutterer

(10) Patent No.: US 11,779,168 B2
(45) **Date of Patent: *Oct. 10, 2023**

(54) MULTI-PURPOSE STORAGE AND DISPENSING APPARATUS

(71) Applicant: Nathan Sutterer, Little Rock, AR (US)

(72) Inventor: Nathan Sutterer, Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/234,575

(22) Filed: Apr. 19, 2021

(65) Prior Publication Data

US 2021/0235944 A1 Aug. 5, 2021

Related U.S. Application Data

(63) Continuation of application No. 16/573,568, filed on Sep. 17, 2019, now Pat. No. 10,980,376.

(60) Provisional application No. 62/732,396, filed on Sep. 17, 2018.

(51) Int. Cl.

| | |
|---|---|
| ***A47K 10/42*** | (2006.01) |
| ***A47K 10/38*** | (2006.01) |
| *A47K 10/32* | (2006.01) |

(52) U.S. Cl.

CPC ..... *A47K 10/42* (2013.01); *A47K 10/38* (2013.01); *A47K 2010/3226* (2013.01); *A47K 2010/3233* (2013.01)

(58) Field of Classification Search

CPC ..... A47K 10/42

See application file for complete search history.

(56) References Cited

U.S. PATENT DOCUMENTS

| | | | |
|---|---|---|---|
| 1,354,511 | A | 10/1920 | Parsons |
| 2,000,454 | A | 5/1935 | Peters |
| 4,106,617 | A | 8/1978 | Boone |
| 5,540,332 | A | 7/1996 | Kopacz et al. |
| D377,284 | S | 1/1997 | Farrow et al. |
| 5,618,008 | A | 4/1997 | Dearwester et al. |
| 6,189,730 | B1 | 2/2001 | McClymonds |
| 6,213,344 | B1 | 4/2001 | Hill |
| 6,273,359 | B1 | 8/2001 | Newman et al. |
| 6,959,890 | B1 | 11/2005 | Breitinger |
| 6,997,342 | B2 | 2/2006 | Mitchell et al. |
| 7,410,052 | B2 | 8/2008 | Cook et al. |
| D764,208 | S | 8/2016 | Shafran |
| 10,980,376 | B2 | 4/2021 | Sutterer |
| 2002/0036208 | A1 | 3/2002 | Faulks et al. |
| 2006/0180596 | A1 | 8/2006 | Young et al. |
| 2007/0181594 | A1 | 8/2007 | Thompson |
| 2008/0061073 | A1 | 3/2008 | Laroche |

(Continued)

OTHER PUBLICATIONS

Official Action for U.S. Appl. No. 16/573,578, dated Feb. 20, 2020, 14 pages.

(Continued)

*Primary Examiner* — Gene O Crawford
*Assistant Examiner* — Ayodeji T Ojofeitimi
(74) *Attorney, Agent, or Firm* — Sheridan Ross P.C.

(57) ABSTRACT

A dispensing device for single-use articles is provided. In certain embodiments, the dispensing device comprises a wall-mounted unit or fixture that is capable of holding at least different articles and providing those articles to a user. Packaging devices for use and cooperation with the dispensing device are further provided, and various systems for storing and dispensing articles are provided.

15 Claims, 7 Drawing Sheets

(56) References Cited

U.S. PATENT DOCUMENTS

| | | | | |
|---|---|---|---|---|
| 2008/0067185 | A1 | 3/2008 | Schlaupltz et al. | |
| 2008/0128451 | A1 | 6/2008 | Krauth et al. | |
| 2008/0169411 | A1 | 7/2008 | Quinn et al. | |
| 2011/0024585 | A1 | 2/2011 | Brlnkdopke et al. | |
| 2011/0315707 | A1 | 12/2011 | Kleinhuber et al. | |
| 2012/0261436 | A1* | 10/2012 | Farrell | A47K 10/3836 221/199 |
| 2014/0021215 | A1 | 1/2014 | Tran | |
| 2015/0083743 | A1 | 3/2015 | D'Angelo | |
| 2015/0374182 | A1* | 12/2015 | Delaney | A47K 10/426 221/45 |

OTHER PUBLICATIONS

Official Action for U.S. Appl. No. 16/573,578, dated Aug. 31, 2020, 11 pages.
Notice of Allowance for U.S. Appl. No. 16/573,578, dated Dec. 21, 2020, 8 pages.

* cited by examiner

MULTI-PURPOSE STORAGE AND DISPENSING APPARATUS

This U.S. Non-Provisional patent application is a Continuation of U.S. Non-Provisional patent application Ser. No. 16/573,568, filed Sep. 17, 2019, which claims the benefit of priority from U.S. Provisional Patent Application Ser. No. 62/732,396, filed Sep. 17, 2018, the entire disclosures of which are hereby incorporated by reference.

FIELD

The present disclosure relates to storing and dispensing devices. More specifically, embodiments of the present disclosure relate to devices and systems for storing and dispensing various items typically provided as single-use items including, for example, wipes, tissues, napkins, and similar products.

BACKGROUND

The use of single sheets provided as interfolded sheets for facial tissue and bath tissue has been widely accepted. The use of single sheets often creates less waste than traditional rolled bath tissue. Additionally, the use of pre-moistened or "wet" sheets has gained wide acceptance for a variety of uses, including bathroom applications. Dry sheets and pre-moistened sheets are generally formed from an absorbent material such as a paper or a polymeric web, or combinations thereof, and may contain a disinfectant, medicament, deodorant, anti-microbial, anti-bacterial, cleansing agent, and so forth, in one or more combinations, on a dry sheet or in a "wet" formulation on a pre-moistened sheet. Pre-moistened sheets are generally stored and dispensed from a container or dispenser to prevent the sheets from drying out.

Various dispenser or container designs for dry sheets as well as pre-moistened sheets have been developed for table top dispensing. In addition, various dispenser designs for dry and/or pre-moistened sheets have been used with existing bathroom fixtures, such as fixtures for conventional rolled products. These dispensers for table top use were not adaptable for use with bath fixtures. Similarly, dispensers for use with bathroom fixtures are not designed for a table top use. In addition, dispensers for use with bath fixtures have often been cumbersome and bulky, and they pose issues with regard to space and mounting considerations as well as ergonomics.

SUMMARY

Accordingly, there has been a long-felt and unmet need to provide a container and dispensing device for single-use wipes and related items that is aesthetically and ergonomically pleasing, while also saving space. In various embodiments, a container and dispensing device for single use wipes is provided that is integrated with a holding device for a roll of conventional rolled toilet paper. In preferred embodiments, the integrated device comprises a mounted or mount-able device that is operable to be provided flush with a surface, such as a wall, vanity, or similar vertically-disposed surface.

In various embodiments, a system is provided for storing and dispensing single use wipes. As used herein, the term "wipes" is intended to refer to a variety of different items of flexible, textile or textile-like material and no limitation with respect to their specific size, features, or intended use is provided herewith. In certain embodiments, the system comprises a container or package of wipes that is operable for interaction with and storage within a holding device. The holding device is contemplated as comprising a wall-mounted or stand-alone device that selectively receives the package of wipes. Accordingly, when a package of wipes is used or exhausted, it may simply be replaced without having to replace, remove, or significantly modify the location and position of the holding device. Holding devices of the present disclosure are contemplated as comprising, but are not limited to, wall-mounted toilet tissue holders with a dedicated space for receiving at least one package of wipes.

In certain embodiments, an arrangement and packaging of items is provided that comprises a unique structure and stacking. U.S. Patent Application Publication No. 2014/0021215 to Tran, which is hereby incorporated by reference in its entirety, discloses various arrangements of tissues and wipes that are stacked and/or folded. Although certain embodiments of the present disclosure contemplate systems and devices suitable for use with such a horizontal stack or arrangement of wipes, embodiments of the present disclosure also contemplate and comprise a stack of wipes or tissues with a novel stacking arrangement. For example, in some embodiments, a container of wipes is provided in the form of a rectangular cube, and an aperture for egress of wipes is provided along the length of the rectangular cube and wherein wipes are removed in a direction substantially normal to a height dimension of the container. In such embodiments, a user need not access wipes from the larger top surface of the container and the wipe container may be stored in an efficient manner and thereby save space.

In one embodiment, a system for holding and dispensing disposable articles is provided that comprises a container having a plurality of articles selected from the group consisting of: wet wipes, towelettes, napkins, toilet seat covers, and paper towels. The container comprises an outer portion with an aperture for dispensing the articles, and a closure member comprising a frame and a rotatable cover member. A dispensing device is provided that comprises a support member for selectively receiving a roll of bath tissue and/or paper towels. The dispensing device comprises an internal volume that is operable to selectively receive the container. The rotatable cover member of the container is provided at least partially external to the dispensing device when the container is provided within the dispensing device such that the rotatable cover member is accessible to a user.

This Summary is neither intended or should it be construed as being representative of the full extent and scope of the present invention. The present invention is set forth in various levels of detail and the Summary as well as in the attached drawings and in the detailed description of the invention and no limitation as to the scope of the present invention is intended by either the inclusion or non-inclusion of elements, components, etc. in the Summary. Additional aspects of the present invention will become more readily apparent from the detailed description, particularly when taken together with the drawings.

BRIEF DESCRIPTION OF THE FIGURES

The accompanying drawings which are incorporated herein and constitute a part of the specification, illustrate various embodiments of numerous inventions and together with the general description of the invention given provide the detailed description, and the drawings serve to explain the principles of these embodiments.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
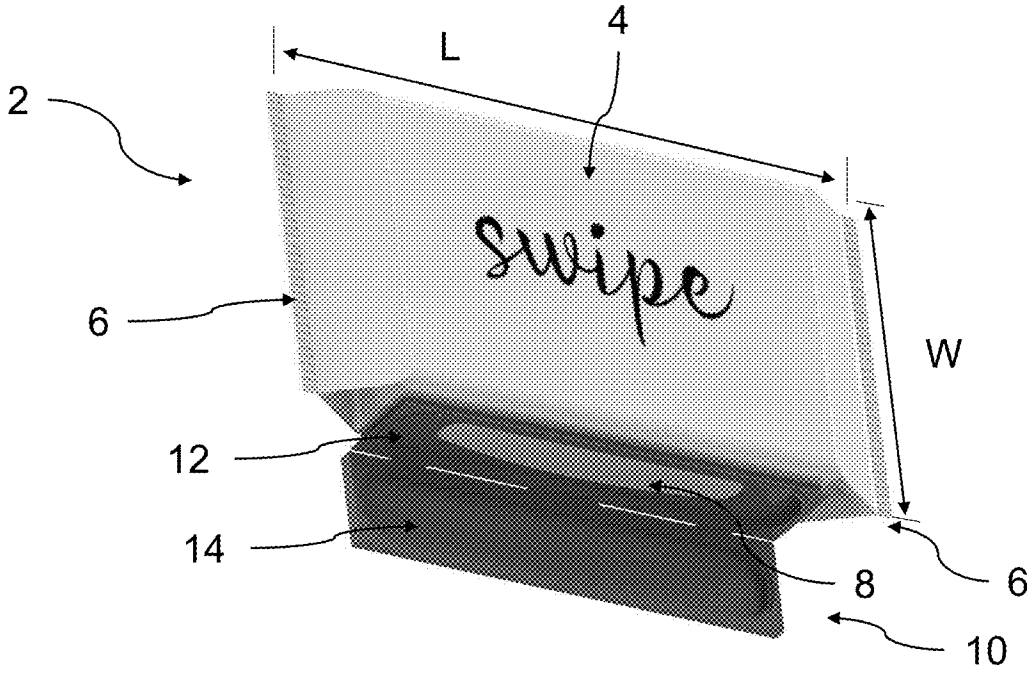
FIG. 1 is a perspective view of a container according to one embodiment of the present disclosure.

FIG. 1 is a perspective view of a container 2 according to one embodiment of the present disclosure. As shown, the container 2 comprises a container for single-use wipes, tissues, napkins, towelettes, toilet seat covers, rags, or similar items. In preferred embodiments, the container 2 comprises and houses single-use items conventionally referred to as "wipes." As shown, the container 2 comprises a partially sealed outer portion 4 for confining and housing a plurality of wipes. The outer portion 4 is sealed or closed on opposing ends by seams or welds 6. The container 2 is generally referred to herein as a rectangular cube, as a stack of wipes provided inside the container will generally form a rectangular cube. As shown in FIG. 1, however, containers of the present disclosure need not necessarily comprise an exact cube-shape as the edges of the device may form a taper that provides only a generally-rectangular cube.

Figure 2:
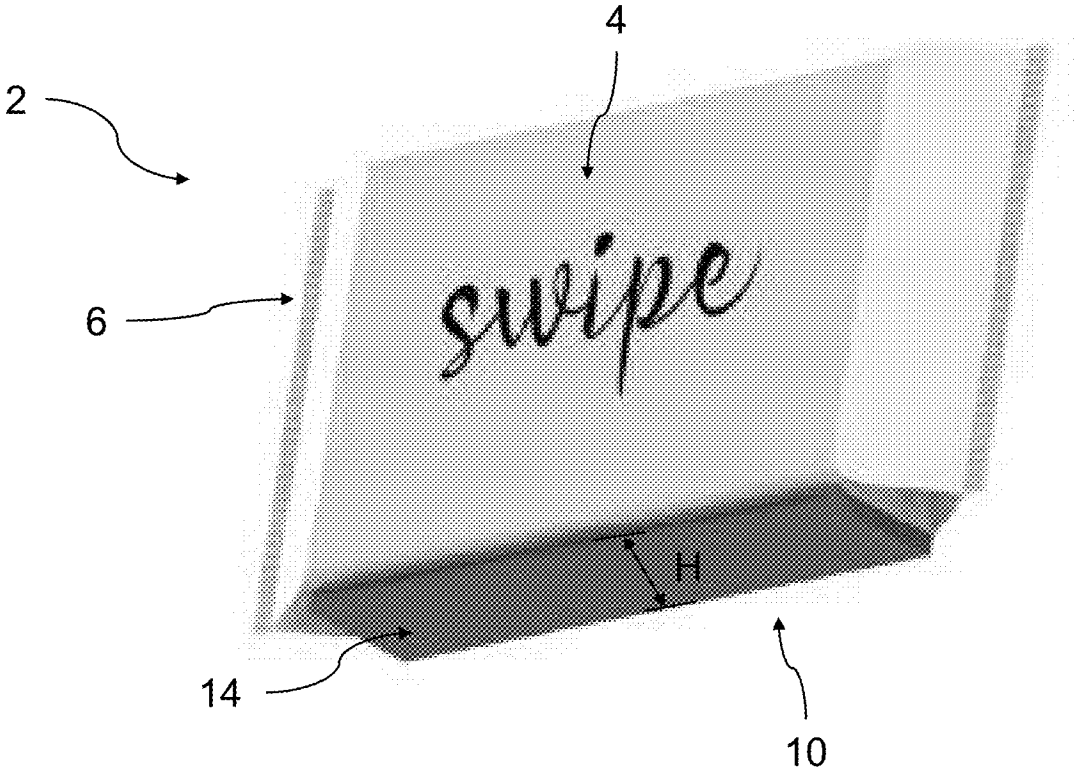
FIG. 2 is a perspective view of the container of the embodiment of FIG. 1.

The container 2 of FIG. 1 comprises a length L, a width W, and a height (not labelled in FIG. 1, but see H in FIG. 2). An opening 8 is provided. In some embodiments, the opening 8 comprises an elongate opening as shown in FIG. 1. The opening 8 in the sidewall of the container 2 comprises an opening that allows for egress of wipes in a direction that is parallel to a plane in which the length L of the container 2 extends. The container 2 comprises a closure member 10, and the closure member 10 comprises a frame 12 with an aperture corresponding to the aperture 8 of the container 2 and a cover 14. The cover 14 is rotatable relative to the frame 12 via at least one hinge and allows for selective access to and closure of the aperture. In various embodiments, the closure member 10 comprises one or more gaskets or seals between the frame 12 and the cover 14 to maintain cleanliness and preserve moisture within the wipes of the container 2.

In various embodiments, the outer portion 4 of the container 2 comprises a flexible plastic such as low-density polyethylene, and the closure member 10 comprises a plastic such as a polyethylene. The closure member 10 preferably comprises a device of enhanced structural rigidity relative to the outer portion 4.

FIG. 2 is a perspective view of the device 2 of FIG. 1, and wherein the cover 14 of the closure member 10 is provided in a closed position. As shown, the device 2 is provided in a substantially sealed or closed position suitable for shipping and storing the device 2 and contents thereof (e.g. wipes). In preferred embodiments, the container 2 comprises a selectively re-closable device wherein the cover 14 comprises a hinged cover that can be opened and closed by hand. In some embodiments, the cover 14 comprises a snap-fit closure that selectively engages a portion of the frame 12.

Figure 4:
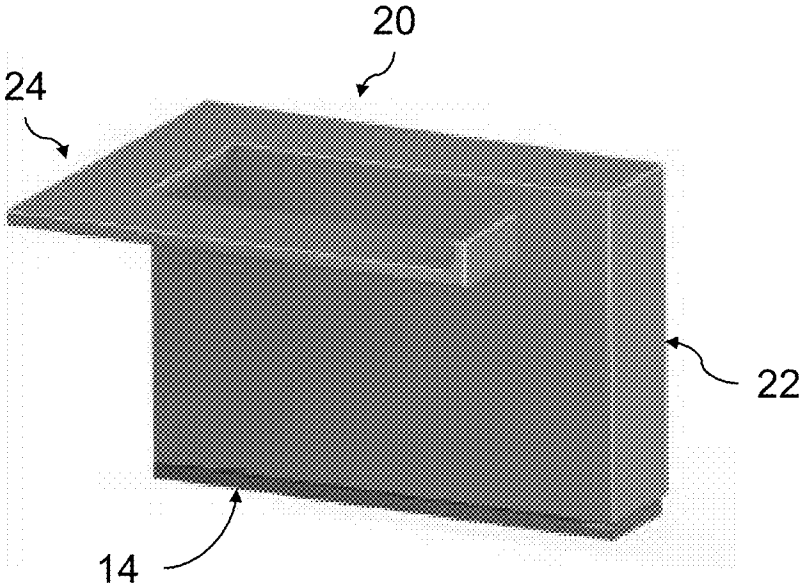
FIG. 4 is a perspective view of the dispensing device of the embodiment of FIG. 3.
Figure 3:
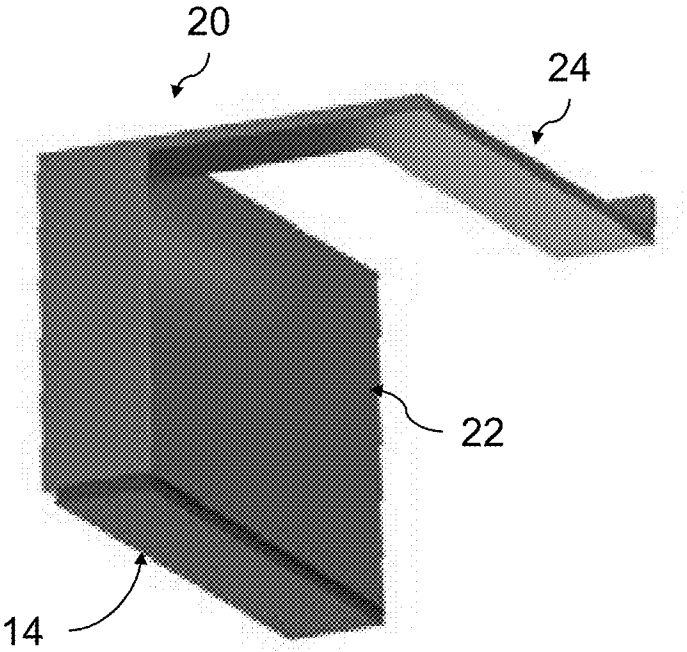
FIG. 3 is perspective view of a dispensing device according to one embodiment of the present disclosure.

FIGS. 3-4 are perspective views of a dispensing device 20 according to one embodiment of the present disclosure. As shown, the device 20 comprises a toilet tissue holding and dispensing apparatus that is operable to selectively receive and retain a container 2 of the present disclosure. The dispensing device 20 comprises a main body portion 22 and a holding portion in the form of a support member 24, such as a cantilevered arm to support a cylindrical roll of toilet tissue. The device 20 of FIGS. 3-4 is shown as a wall-mounted or wall-mountable device with a cantilevered arm 24 for receiving a roll of toilet tissue or paper towels. It should be recognized, however, that embodiments of the present disclosure are not limited to this particular arrangement. It is contemplated that containers such as the container 2 shown in FIGS. 1-2 are provided in combination with wall-mounted tissue holders of various different types and arrangements including, but not limited to those with compression-cylinders, hinged arms, etc. and are also contemplated as being provided in stand-alone type holders that are not mounted to a surface.

As shown in FIGS. 3-4, a container for disposable wipes is provided within an internal volume of the main body portion 22 of the device 20. The container and associated wipes are provided within the device 20 and are accessible from a lower portion thereof. Specifically, the cover 14 of the container 2 is provided such that it is accessible to a user and may be selectively opened to access stored contents. In certain embodiments, a lip or extension is provided on the cover 14 to allow for easy opening of the cover 14. Substantially all of the volume of the container 2 is disposed within the device 20 to create a clean and aesthetically pleasing appearance. Additionally, the larger length and width dimensions of the container 2 are provided parallel to a vertical surface (at least in embodiments wherein the device 20 comprises a wall-mounted device), and the height dimension of the container extends away from the wall such that a minimal amount of space is occupied.

Figure 6:
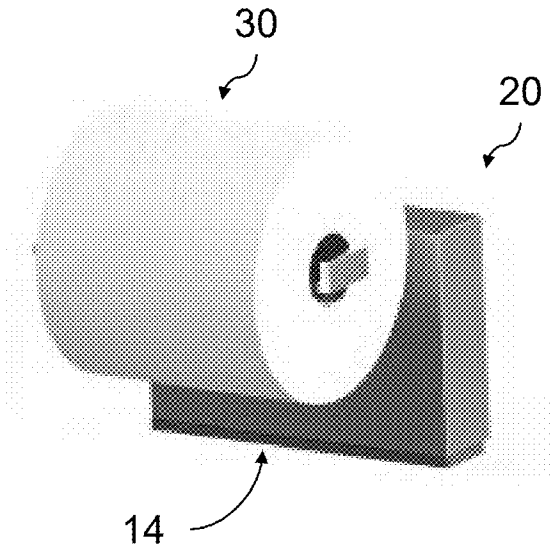
FIG. 6 is a perspective view of the dispensing device of the embodiment of FIG. 3.
Figure 5:
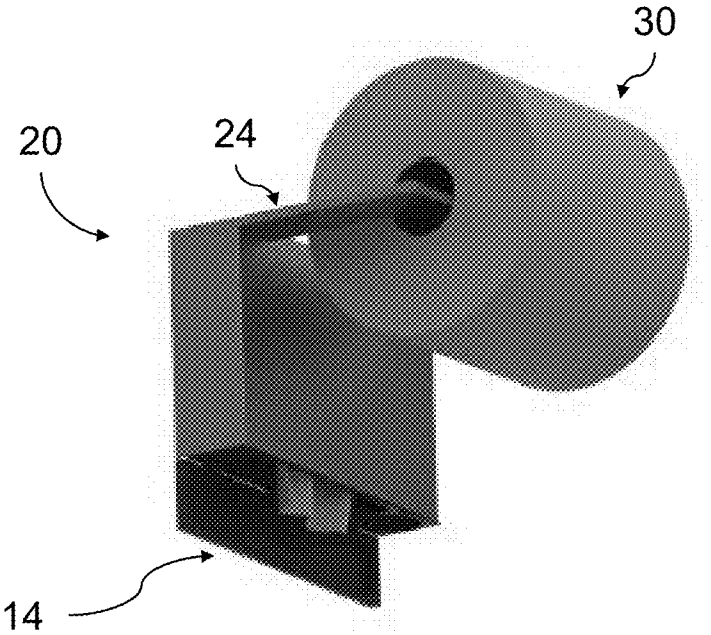
FIG. 5 is a perspective view of the dispensing device of the embodiment of FIG. 3.

FIGS. 5-6 are perspective views of the embodiment of FIGS. 3-4. As shown in FIGS. 5-6, a conventional and known roll of toilet tissue 30 is provided on the dispensing device 20. Additionally, a container 2 according to embodiments of the present disclosure is provided within the main body portion of the dispensing device 20. As shown in FIG. 5, the contents of the container are accessible from a bottom portion thereof wherein the cover member 14 is provided in an open position. In FIG. 6, the cover 14 is closed, providing a neat and aesthetically pleasing overall appearance. In various embodiments, the container 2 comprises a lip or similar support member to selectively engage the dispensing device 20 and maintain the container in a position within the dispensing device.

Figure 7C:
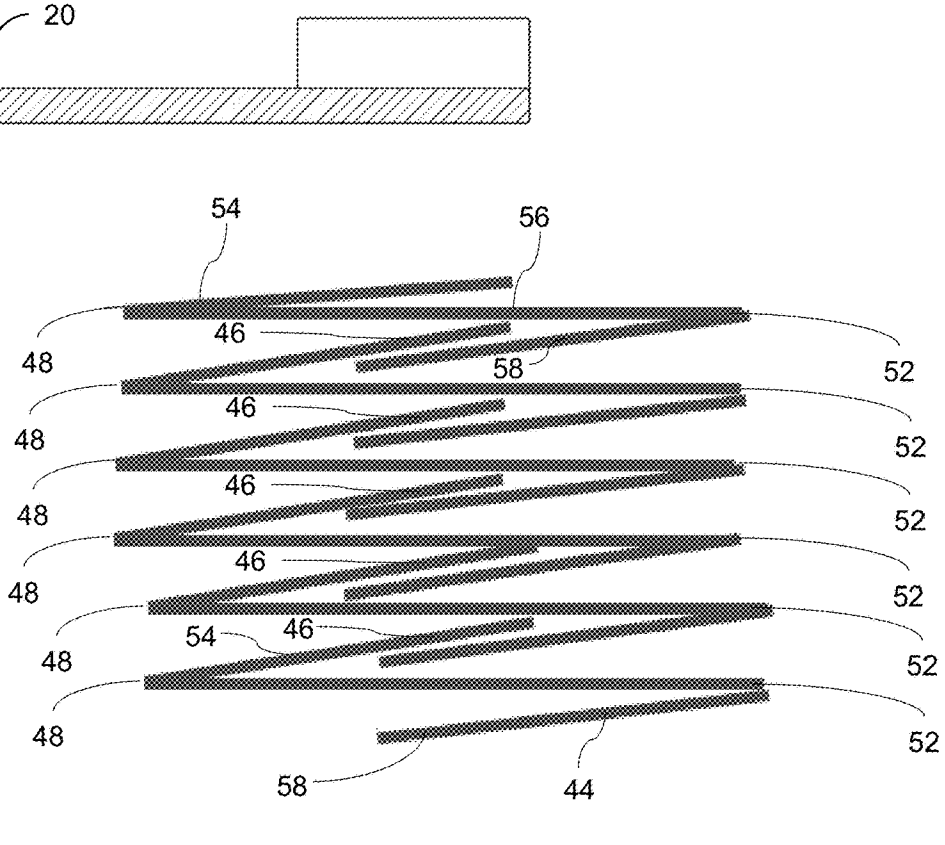
FIG. 7C is an enlarged view of the plurality of discrete components provided in a stacked arrangement according to the embodiment of FIG. 7A.
Figure 7B:
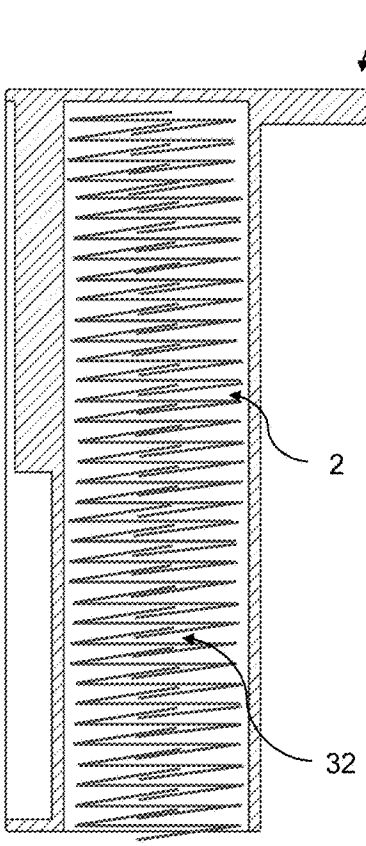
FIG. 7B is a cross-sectional view of the dispensing device according to an embodiment of the present disclosure.
Figure 7A:
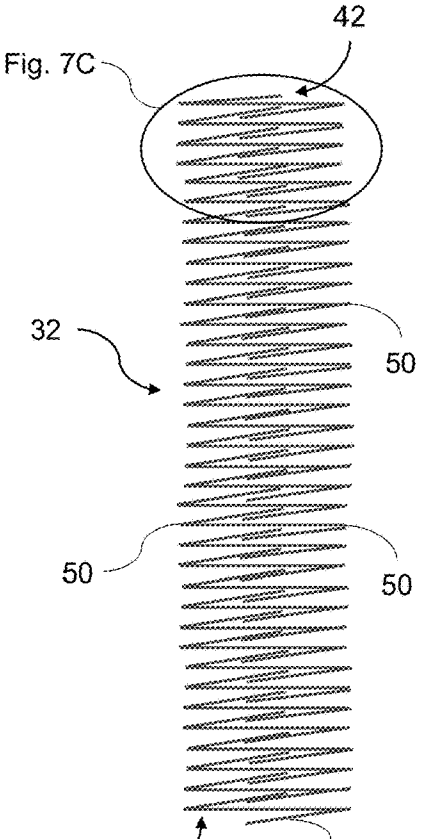
FIG. 7A is a cross-sectional elevation view of a plurality of discrete components provided in a stacked arrangement according to one embodiment of the present disclosure.

FIG. 7A is a cross-sectional view of a stack 32 of single-use wipes 50 according to an embodiment of the present disclosure. The stack 32 comprises a plurality of individual wipes 50. The stack 32 is shown without a container or dispensing device for illustrative purposes. The stack 32 has a first end 40 and a second end 42. In an assembled state, the first end 40 is located near a frame 12 of the dispensing device 20, such that an exposed wipe 44 is accessible through the frame 12.

FIG. 7B is a cross-sectional view of a container 2 according to an embodiment of the present disclosure, and wherein a plurality of wipes 50 are provided within the container 2. The container 2 and stacked single use wipes 50 are shown inside of a dispensing device 20. The wipes 50 are folded and stacked vertically in an overlapping manner. Accordingly, when a wipe 50 is removed, an adjacent wipe 50 is pulled through the frame 12 along with it, partially exposing the next wipe 50 (see FIG. 5). This configuration allows users to easily remove wipes 50 from the container 2. It will be appreciated that the particular fold pattern shown in FIG. 7 is not necessary to achieve the pull-through design, which exposes sequential wipes.

FIG. 7C is an enlarged view of the stacked wipes shown in FIGS. 7A and 7B. Each individual wipe 50 comprises two folds 48, 52 and the plurality of wipes are provided in series as shown in FIGS. 7A and 7C. A wipe 50 at the first end 40 is only in contact with a top wipe, and the wipe at the second end 42 is only in contact with a bottom wipe. The first fold 48 is between a first part 54 and a second part 56, and the second fold 52 is between the second part 56 and the third part 58. The first part 54 and the third part 58 of each wipe 50 overlap at an overlap section 46. The first part 54 and the third part 58 each make up about thirty percent of the cross-sectional length, and the second part makes up about forty percent of the cross-sectional length of a wipe 50. The overlap section 46 makes up about ten to twenty percent of the cross-sectional length of each wipe 50.

Figure 8:
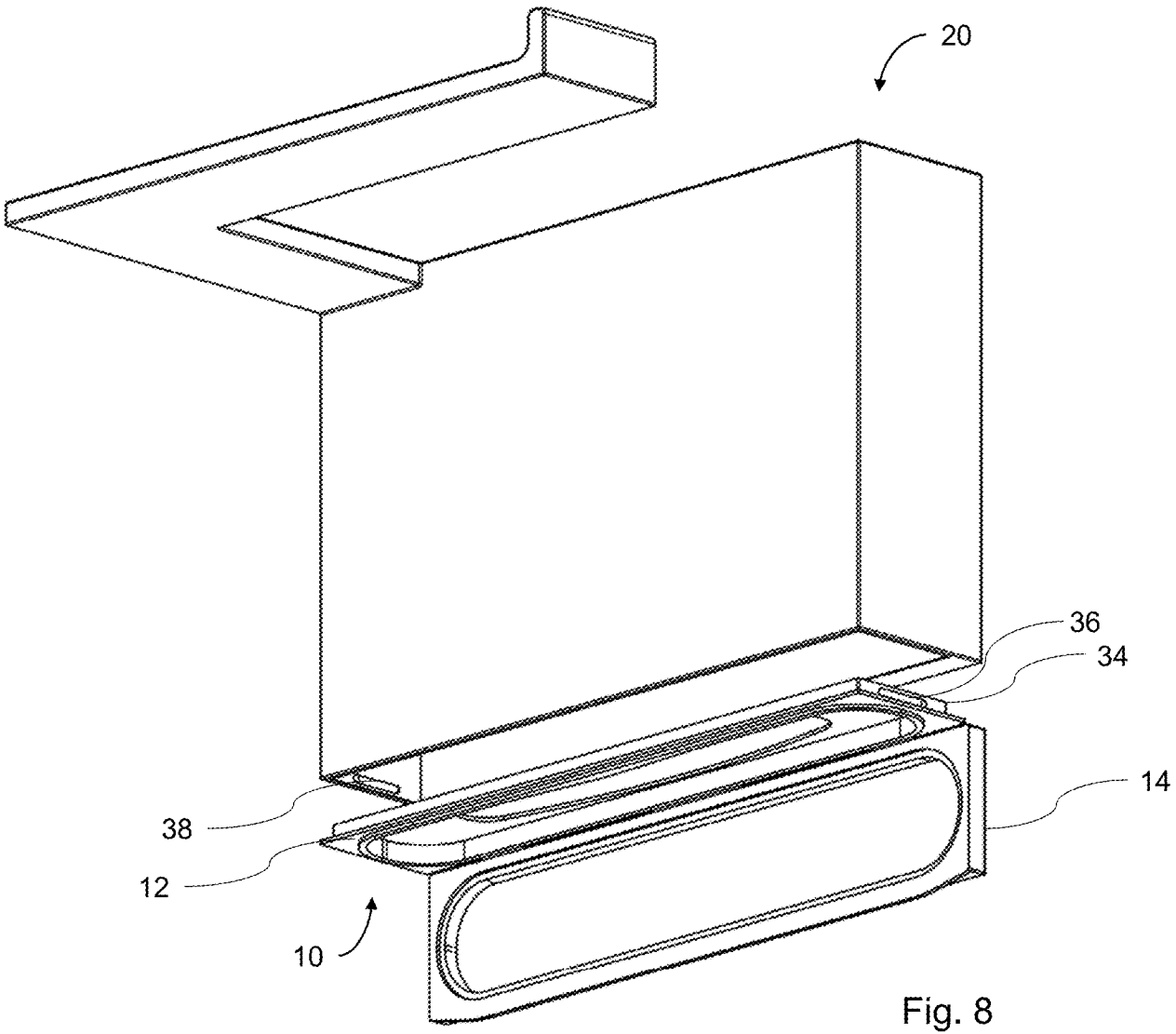
FIG. 8 is a partially-exploded perspective view of a dispensing device according to one embodiment of the present disclosure.

FIG. 8 is a partially-exploded perspective view of a dispensing device 20 showing the closure member 10 detached from the dispensing device 20 according to various embodiments of the present disclosure. In FIG. 8, the frame 12 of closure member 10 comprises a lip portion 34, which is set in from the edge of the frame 12 and substantially surrounds a perimeter of the frame 12. The lip portion 34 comprises one or more slots 36, which mate with a tab 38 on the dispensing device 20. In alternative embodiments, the slots 36 and tabs 38 are inverted such that a female portion is provided on the dispensing device 20 and the frame 12 comprises a male projection. The lip portion 34 is sized to fit tightly within the dispensing side of the dispensing device 20. The closure member 10 can be pressed or snap-fit into the dispensing device 20, and the tabs 38 fit into the slots 36, holding the cover 14, and the container 2 inside the dispensing device 20. A bending force can be applied to the closure member 10 to remove an empty container 2 from the dispensing device 20. The closure member 10 of FIG. 8 is shown without a corresponding container 2. In some embodiments, and as shown in FIG. 1, a container 2 and a closure member 10 comprises a co-formed or joined element. In alternative embodiments, the container 2 and closure member 10 comprise separate components.

In various embodiments, the cover member 14 of the closure member 10 comprises at least one magnet, and at least one of the frame 12 and the dispensing device comprises a magnet of opposite polarity to create a closing force upon the cover member 14, at least when the container 2 is provided within the dispensing device 20. In various embodiments, the cover member 14 is the only cover member for wipes contained within a system, and the dispensing device 20 comprises an open bottom portion. In alternative embodiments, the dispensing device 20 comprises a rotatable closure member of its own. Such a closure member may comprise a spring-loaded closure or cover and, in some embodiments, a cover member 14 of a container 2 is operable to communicate with the closure of the dispensing device 20.

Figure 9A:
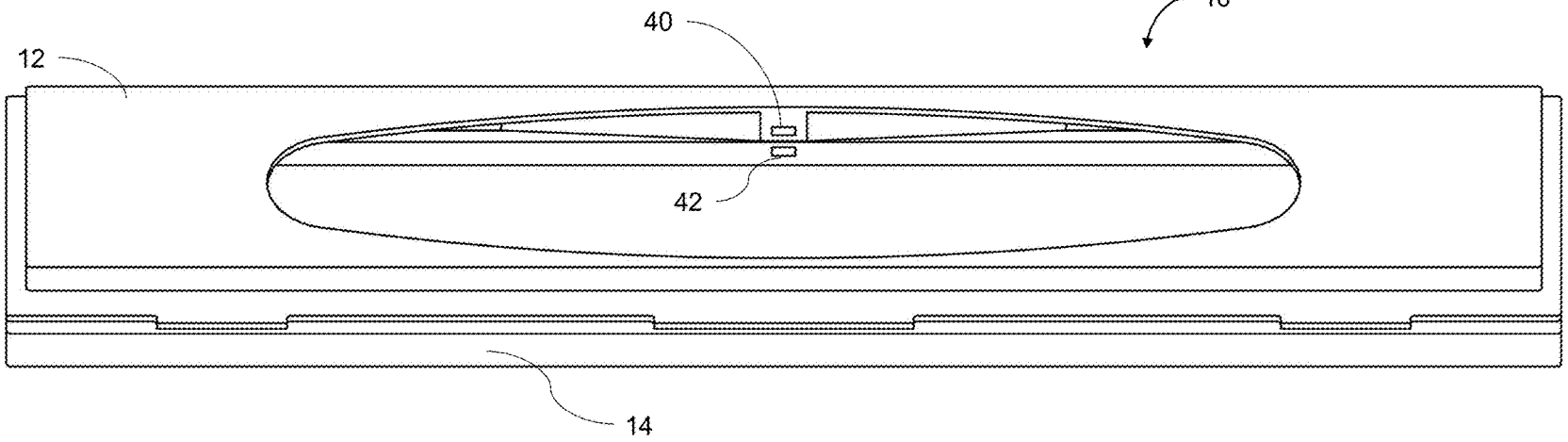
FIG. 9A is a bottom view of a portion of a dispensing device according to one embodiment of the present disclosure.

FIG. 9A is a bottom view of a cover 10 according to various embodiments of the present disclosure. Referring briefly to FIGS. 1, 5, and 8, the closure member 10 is shown in an open position, such that wipes 32 can be removed from the container 2. In FIGS. 2 and 6, the closure member 10 is shown in a closed position, such that the cover 14 is closed over the top of the frame 12. Similarly, FIG. 9A depicts the closure member 10 in a closed position showing frame magnet 40 and cover magnet 42. The magnets 40, 42 are positioned so that the magnets 40, 42 overlap when the closure member 10 is in a closed position. A magnetic force holds the cover 14 of the closure member 10 in the closed position. A user can apply a force to overcome the magnetic force and open the cover 14 to remove a wipe 32. A user can then close the cover 14 over the frame 12 to provide the closure member 10 in a closed position. This keeps the wipes 32 from being exposed to air, so the wipes 32 are hygienically sealed and can maintain the desired level of moisture.

Figure 9B:
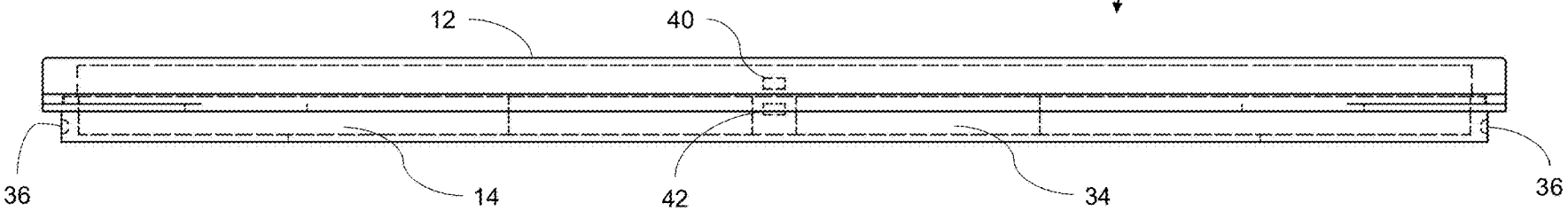
FIG. 9B is a front elevation view of the dispensing device cover according to the embodiment of FIG. 9A.

FIG. 9B is a front view of the closure member 10 according to the embodiment shown in FIG. 9A. The magnets 40, 42 are nearly overlapping, and a magnetic force holds the closure member 10 in a closed position. The slots 36 are shown on either end of the frame 12.

In various embodiments, devices of the present disclosure provide a means of providing a concealed stack of wipes or similar items, while still allowing for ease of access to such a device.

While the present invention has been illustrated by description of preferred embodiments and while the illustrative versions have been described in considerable detail, it is not the intention of the inventors to restrict or in any way limit the scope of the appended claims to such detail. Additional advantages and modifications will readily appear to those skilled in the art upon reading this detailed description. Therefore, the invention, in its broader aspects, is not limited to these specific details, respective apparatus and methods, and illustrative examples shown and described. Accordingly, departures may be made from such details without departing from the spirit or scope of the inventor's general inventive concepts.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A surface-mounted dispensing device for storing and dispensing disposable articles, the dispensing device comprising:

a main body portion and a support member for selectively receiving and supporting a roll of paper product, the support member extending from the main body portion so that at least a part of the main body portion is disposed between the support member and the surface to which the main body portion is mounted;

the main body portion comprising a substantially planar rear surface that is operable to be provided flush with a surface;

wherein the main body portion comprises an internal volume that is sized and operable for receiving a plurality of the articles, and wherein the main body portion comprises an opening for accessing the internal volume;

wherein the main body portion comprises a lip portion with at least one slot for egress of the articles; and a rotatable closure member to allow for selective egress of the articles from the internal volume at least when the rotatable closure member is provided in an open position.

2. The surface-mounted dispensing device of claim 1, wherein the internal volume of the dispensing device comprises an internal volume of not more than approximately 250 square inches.

3. The surface-mounted dispensing device of claim 1, wherein the articles comprise wet wipes, towelettes, napkins, toilet seat covers, or paper towels.

4. The surface-mounted dispensing device of claim 1, wherein the paper product comprises at least one of bath tissue and paper towels.

5. The surface-mounted dispensing device of claim 1, wherein the support member comprises a non-rotatable cantilevered arm.

6. The surface-mounted dispensing device of claim 1, wherein the closure member is rotatable relative to the main body portion.

7. The surface-mounted dispensing device of claim 1, wherein the internal volume of the dispensing device comprises an internal volume of not more than approximately 250 square inches.

8. The surface-mounted dispensing device of claim 1, wherein the rotatable cover member comprises a magnet to secure the rotatable cover member in a closed position.

9. A surface-mounted system for storing and dispensing disposable articles, the system comprising:

a container comprising a plurality of articles;

wherein the container comprises an outer portion having an aperture for dispensing the articles;

wherein the plurality of articles is provided in a manner suitable for dispensing the articles in a single use manner through the aperture; and a surface-mounted dispensing device comprising a main body portion and a support member for selectively receiving a roll of paper product, the support member extending from the main body portion such that at least part of the main body portion is disposed between the support member and the surface to which the dispensing device is mounted;

wherein the main body portion comprises an internal volume that is sized and operable to receive the container;

wherein the main body portion comprise an opening providing access to the internal volume;

wherein at least one of the container and the main body portion of the surface-mounted dispensing device comprises a rectilinear cube having a length, a width, and a height;

wherein the length is larger than the width and the width is larger than the height; and wherein the articles are dispensed through a plane in which the length and height extend.

10. The system of claim 9, wherein the articles comprise wet wipes, towelettes, napkins, toilet seat covers, or paper towels.

11. The system of claim 9, wherein the paper product is bath tissue or paper towels.

12. The system of claim 9, wherein the support member comprises a fixed cantilevered arm.

13. The system of claim 9, wherein the container comprises a frame with a lip portion that substantially surrounds a perimeter of the frame, and wherein the lip portion comprises a means for mating with the main body portion.

14. The system of claim 13, wherein the means for mating with the main body portion comprises at least one of a tab or a slot.

15. The system of claim 9, further comprising a rotatable cover member having a magnet to secure the rotatable cover member in a closed position.

* * * * *